US009728851B2

(12) United States Patent
Chang et al.

(10) Patent No.: US 9,728,851 B2
(45) Date of Patent: Aug. 8, 2017

(54) MOBILE COMMUNICATION DEVICE

(71) Applicant: Acer Incorporated, New Taipei (TW)

(72) Inventors: Chih-Hua Chang, New Taipei (TW); Wan-Chu Wei, New Taipei (TW)

(73) Assignee: Acer Incorporated, New Taipei (TW)

( * ) Notice: Subject to any disclaimer, the term of this patent is extended or adjusted under 35 U.S.C. 154(b) by 60 days.

(21) Appl. No.: 14/249,356

(22) Filed: Apr. 10, 2014

(65) Prior Publication Data

US 2015/0091774 A1 Apr. 2, 2015

(30) Foreign Application Priority Data

Oct. 2, 2013 (TW) ..... 102135762 A

(51) Int. Cl.

| | |
|---|---|
| ***H01Q 1/48*** | (2006.01) |
| ***H01Q 5/321*** | (2015.01) |
| ***H01Q 1/24*** | (2006.01) |
| ***H01Q 9/42*** | (2006.01) |
| ***H01Q 5/378*** | (2015.01) |

(52) U.S. Cl.

CPC ..... *H01Q 5/321* (2015.01); *H01Q 1/243* (2013.01); *H01Q 5/378* (2015.01); *H01Q 9/42* (2013.01)

(58) Field of Classification Search

USPC ..... 343/700 MS, 702, 845, 861, 745

See application file for complete search history.

(56) References Cited

U.S. PATENT DOCUMENTS

| | | | | |
|---|---|---|---|---|
| 2006/0187128 | A1* | 8/2006 | Lu | H01Q 1/243 343/702 |
| 2007/0103367 | A1* | 5/2007 | Wang | H01Q 9/42 343/700 MS |
| 2010/0053007 | A1* | 3/2010 | Ni | H01Q 9/0421 343/745 |
| 2010/0176999 | A1 | 7/2010 | Anguera et al. | |
| 2010/0245195 | A1* | 9/2010 | Wilson | H01Q 1/007 343/750 |
| 2011/0128200 | A1* | 6/2011 | Hossain | H01Q 7/00 343/745 |
| 2011/0134009 | A1 | 6/2011 | Onaka et al. | |
| 2012/0162038 | A1 | 6/2012 | Lee | |

FOREIGN PATENT DOCUMENTS

| | | |
|---|---|---|
| CN | 101573831 | 11/2009 |
| CN | 103138042 | 6/2013 |
| CN | 103199335 | 7/2013 |
| CN | 103367874 | 10/2013 |
| EP | 1475889 | 11/2004 |
| TW | M286423 | 1/2006 |

OTHER PUBLICATIONS

Wong et al., "Small-size WWAN tablet computer antenna with distributed and lumped parallel resonant circuits" Microwave Opt. Technol. Lett, Jun. 2012, pp. 1348-1353.

* cited by examiner

*Primary Examiner* — Jessica Han

*Assistant Examiner* — Hai Tran

(74) *Attorney, Agent, or Firm* — Jianq Chyun IP Office

(57) ABSTRACT

A mobile communication device including a ground plane, a radiation element and a resonant circuit is provided. The radiation element is electrically connected to the ground plane. The resonant circuit is electrically connected to the radiation element and receives a feeding signal. The resonant circuit and the radiation element resonate at a resonant frequency and excite the ground plane to generate a resonant mode.

8 Claims, 3 Drawing Sheets

100

200

300

MOBILE COMMUNICATION DEVICE

CROSS-REFERENCE TO RELATED APPLICATION

This application claims the priority benefit of Taiwan application serial no. 102135762, filed on Oct. 2, 2013. The entirety of the above-mentioned patent application is hereby incorporated by reference herein and made a part of this specification.

BACKGROUND OF THE INVENTION

Field of the Invention

The invention relates to a mobile communication device, and more particularly, to a mobile communication device having a ground plane antenna.

Description of Related Art

With rapid developments and applications of the wireless communication technology, various mobile communication devices have been continuously popularized on the market. In addition, multi-functional mobile communication devices (e.g., smart phones, tablet computers and notebook computers and so forth) bring people more convenient life. Currently, due to trend in miniature design of the mobile communication devices, an inner space of the mobile communication device is compressed. Accordingly, a disposition space for an antenna element in the mobile communication device is also limited, resulting that the antenna element needs to be miniaturized correspondingly.

However, a size of the antenna element or a clearance area cannot be reduced continuously. A major reason is that a radiation element of the antenna element is served as a radiator in general antenna design. Therefore, the radiation element of the antenna requires sufficient area for a radiation characteristic of the antenna element to meet requirements in basic communication performance. In other words, under developments in miniature design of the mobile communication devices, the size of the antenna is usually limited, and therefore influences the radiation characteristic of the antenna element.

SUMMARY OF THE INVENTION

The invention is directed to a mobile communication device which forms an antenna element by utilizing a radiation element and a resonant circuit, and the antenna element is capable of radiating through a resonant mode generated by a ground plane. Accordingly, a size of the antenna element can be effectively reduced while maintaining a radiation characteristic of the antenna element.

A mobile communication device of the invention includes a ground plane, a radiation element and a resonant circuit. The radiation element is electrically connected to the ground plane. The resonant circuit is electrically connected to the radiation element and receives a feeding signal. The resonant circuit and the radiation element resonate at a resonant frequency and excite the ground plane to generate a resonant mode.

Based on above, the invention forms an antenna element by utilizing the radiation element which is connected to the ground plane and the resonant circuit, and the antenna element excites the ground plane to generate a resonant mode. Accordingly, the antenna element can form a ground plane antenna and radiate through the resonant mode generated by the ground plane. Accordingly, a size of the antenna element can be effectively reduced while maintaining a radiation characteristic of the antenna element.

To make the above features and advantages of the disclosure more comprehensible, several embodiments accompanied with drawings are described in detail as follows.

DESCRIPTION OF THE EMBODIMENTS

Figure 1:
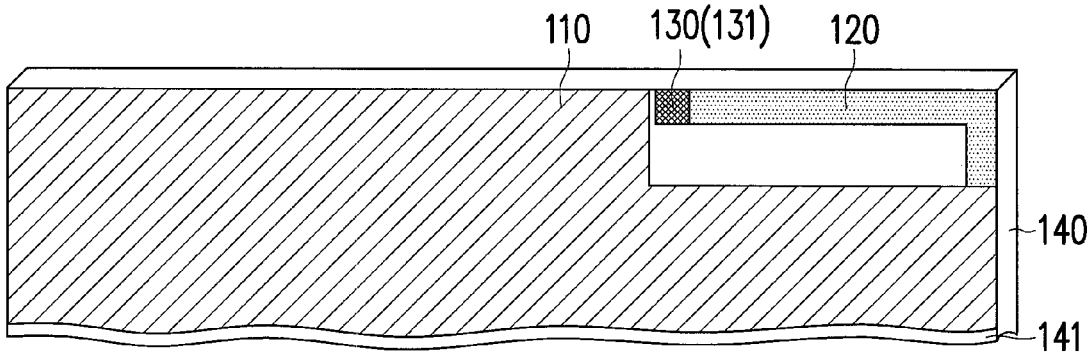
FIG. 1 is a schematic diagram of a mobile communication device according to an embodiment of the invention.

FIG. 1 is a schematic diagram of a mobile communication device according to an embodiment of the invention. Referring to FIG. 1, a mobile communication device 100 includes a ground plane 110, a radiation element 120 and a resonant circuit 130. The radiation element 120 is electrically connected to the ground plane 110, and the resonant circuit 130 is electrically connected to the radiation element 120.

In overall disposition, the ground plane 110, the radiation element 120 and the resonant circuit 130 are not overlapping with one another. For instance, the mobile communication device 100 further includes a substrate 140. The ground plane 110 is disposed on a first surface 141 of the substrate 140. In addition, an area of the first surface 141 of the substrate 140 on which the ground place 110 is not disposed may be regarded as a clearance area, and the clearance area may be used to dispose the radiation element 120 and the resonant circuit 130.

During operations, the resonant circuit 130 and the radiation element 120 can form an antenna element, and the antenna element is substantially equivalent to a loop antenna. A terminal of the antenna element receives a feeding signal through the resonant circuit 130, and another terminal of the antenna element is electrically connected to the ground plane 110 through the radiation element 120. In addition, the radiation element 120 may provide an equivalent inductance, and resonate at a resonant frequency together with the resonant circuit 130. In other words, the resonant circuit 130 and the radiation element 120 act as a resonator rather than a radiator.

Moreover, the antenna element formed by the resonant circuit 130 and the radiation element 120 can be used to excite the ground plane 110, thereby causing the ground plane 110 to generate a resonant mode. Accordingly, the antenna element can radiate through the resonant mode generated by the ground plane 110. In other words, the antenna element is also equivalent to a ground plane antenna. That is, said antenna element is the ground plane antenna having a loop antenna structure.

It should be noted that, because the antenna element can radiate through the resonant mode of the ground plane 110, a size of the antenna element can be effectively reduced while maintaining the radiation characteristic of the antenna element. For instance, in the embodiment of FIG. 1, a length of a resonant path of the antenna element is 0.1 to 0.2 times a wavelength of the resonant frequency. In contrast, for a conventional loop antenna, a length of a resonant path thereof is 0.5 times a wavelength of a resonant frequency.

More specifically, the radiation element 120 is an L-shape metal piece, and the resonant circuit 130 is composed of a capacitive element 131. A first terminal of the capacitive element 131 is electrically connected to the radiation element 120, and a second terminal of the capacitive element 131 is configured to receive the feeding signal. In addition, the capacitive element 131 may be a variable capacitor or a fixed capacitor. Furthermore, the capacitive element 131 may be used to adjust the resonant frequency of the antenna element. For example, the resonant frequency of antenna element is proportional to a capacitance of the capacitive element 131. That is, the resonant frequency of the antenna element may be raised by increasing the capacitance of the capacitive element 131.

Figure 2:
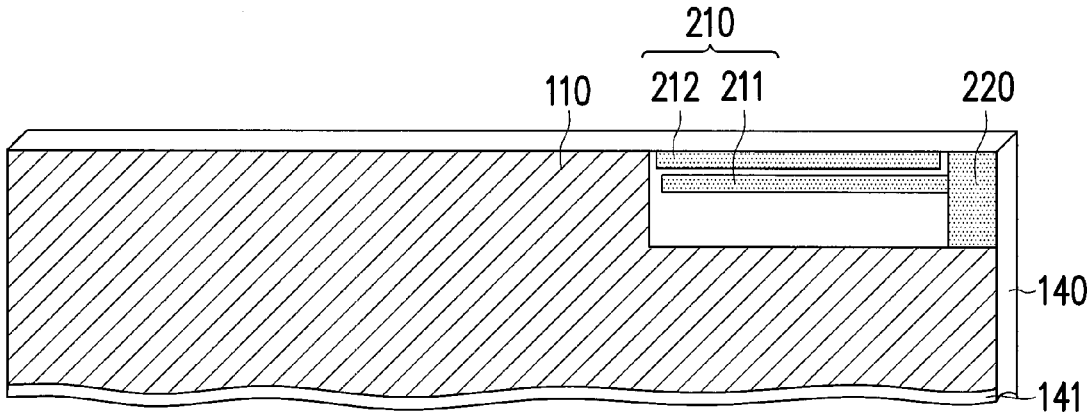
FIG. 2 is a schematic diagram of a mobile communication device according to another embodiment of the invention.

It should be noted that, the capacitive element in the resonant circuit 130 may also be constituted by using conductive lines. For instance, FIG. 2 is a schematic diagram of a mobile communication device according to another embodiment of the invention. A mobile communication device 200 depicted in FIG. 2 is an extension of the embodiment of FIG. 1, a major difference between the two is that: a radiation element 220 is a rectangular metal piece, and a resonant circuit 210 includes a first conductive line 211 and a second conductive line 212. More specifically, the first conductive line 221 is electrically connected to the radiation element 220. The second conductive line 212 is configured to receive the feeding signal. Further, the second conductive line 212 and the first conductive line 211 are spaced apart by a coupling distance. Accordingly, the second conductive line 212 and the first conductive line 211 can form a distributed capacitor for providing an equivalent capacitance. Detailed description regarding other components of the embodiment of FIG. 2 has been included in the embodiment of FIG. 1, thus it is omitted hereinafter.

Figure 3:
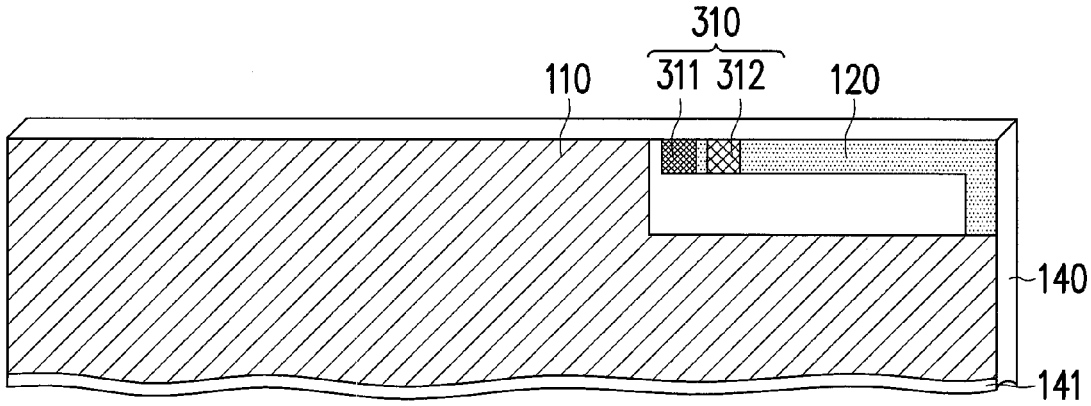
FIG. 3 is a schematic diagram of a mobile communication device according to another embodiment of the invention.

FIG. 3 is a schematic diagram of a mobile communication device according to another embodiment of the invention. A mobile communication device 300 depicted in FIG. 3 is an extension of the embodiment of FIG. 1, a major difference between the two is that: a resonant circuit 310 includes a capacitive element 311 and an inductive element 312. More specifically, a first terminal of the inductive element 312 is electrically connected to the radiation element 120, and a second terminal of the inductive element 312 is electrically connected to a first terminal of the capacitive element 311. In addition, a second terminal of the capacitive element 311 is configured to receive the feeding signal. Herein, the inductive element 312 and the radiation element 120 may both be used to provide an inductance. Therefore, by using the inductive element 312, a length of the radiation element 120 may be adjusted in response to the inductance of the inductive element 312, so as to improve flexibility of the antenna element in terms of design. Detailed description regarding other components of the embodiment of FIG. 3 has been included in the embodiment of FIG. 1, thus it is omitted hereinafter.

Figure 4:
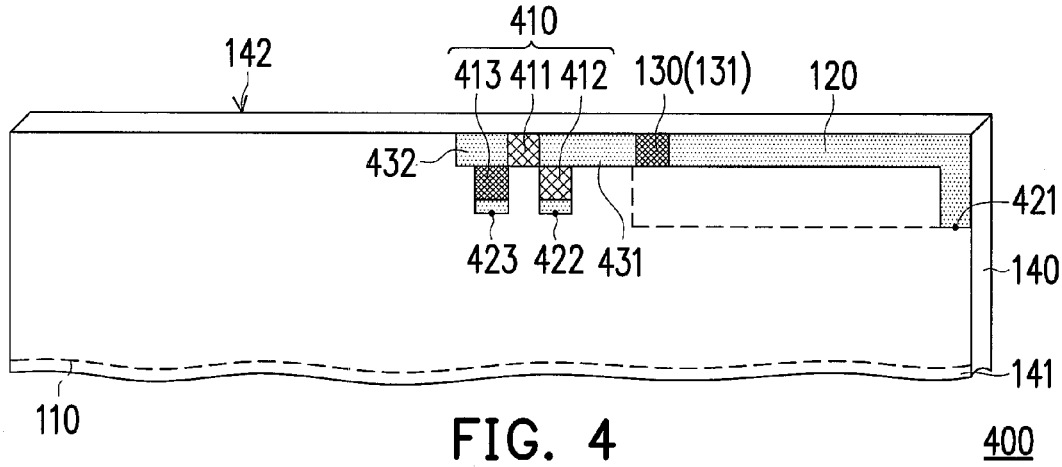
FIG. 4 is a schematic diagram of a mobile communication device according to another embodiment of the invention.

The mobile communication device 100 may further improve the radiation characteristic of the antenna element through a matching circuit. For instance, FIG. 4 is a schematic diagram of a mobile communication device according to another embodiment of the invention. A mobile communication device 400 depicted in FIG. 4 is an extension of the embodiment of FIG. 1, a major difference between the two is that: a ground plane 110 is disposed on the second surface 142 of the substrate 140, and the mobile communication device 400 further includes a matching circuit 410.

More specifically, the radiation element 120, the resonant circuit 130 and the matching circuit 410 are disposed on the first surface 141 of the substrate 140, and a relative position of the ground plane 110 projected on the first surface 141 of the substrate 140 is further represented by a dash line in FIG. 4. Because the radiation element 120 and the ground plane 110 are disposed on the two opposite surfaces 141 and 142, respectively, and the radiation element 120 is electrically connected to the ground plane 110 through a via hole 421. Further, the resonant circuit 130 receives the feeding signal from a transceiver (not illustrated) in the mobile communication device 400 through the matching circuit 410. In addition, the matching circuit 410 may be used to adjust an impedance matching between the resonant circuit 130 and the transceiver, so as to improve the radiation characteristic of the antenna element.

More specifically, the matching circuit 410 includes an inductive element 411, an inductive element 412 and a capacitive element 413. A first terminal of the inductive element 411 is electrically connected to the resonant circuit 130, and a second terminal of the inductive element 411 receives the feeding signal. The inductive element 412 is electrically connected between the first terminal of the inductive element 411 and the ground plane 110. The capacitive element 413 is electrically connected between the second terminal of the inductive element 411 and the ground plane 110.

Because the matching circuit 410 and the ground plane 110 are disposed on the two opposite surfaces 141 and 142, the inductive element 412 and the capacitive element 412 are electrically connected to the ground plane 110 through via holes 422 and 423. In addition, the inductive element 411, the inductive element 412 and the capacitive element 413 are electrically connected to one another through conductive lines, or electrically connected to the resonant circuit 130, the ground plane 110 or other components through conductive lines. Therefore, FIG. 4 further illustrates a plurality of conductive lines, such as conductive lines 431 to 432. Further, the capacitive element 413 may be a variable capacitor or a fixed capacitor. Detailed description regarding other components of the embodiment of FIG. 4 has been included foregoing embodiments, thus it is omitted hereinafter.

Figure 5:
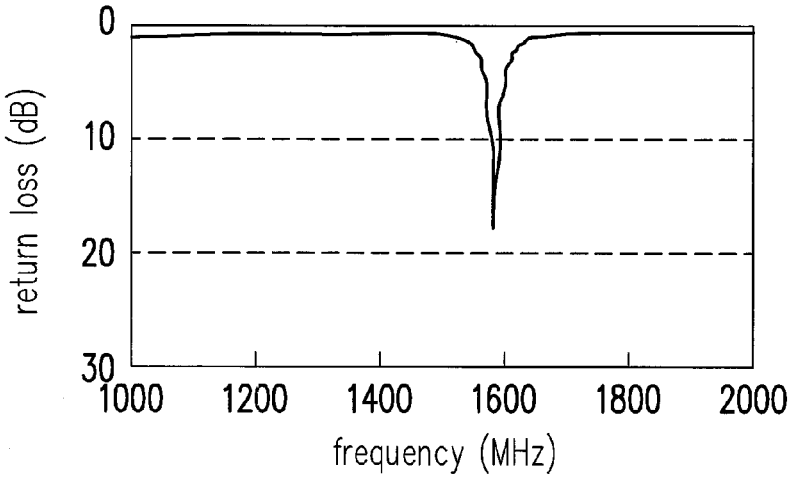
FIGS. 5 and 6 are diagrams for illustrating return loss diagram and antenna efficiency of the antenna element of embodiment of FIG. 4.
Figure 6:
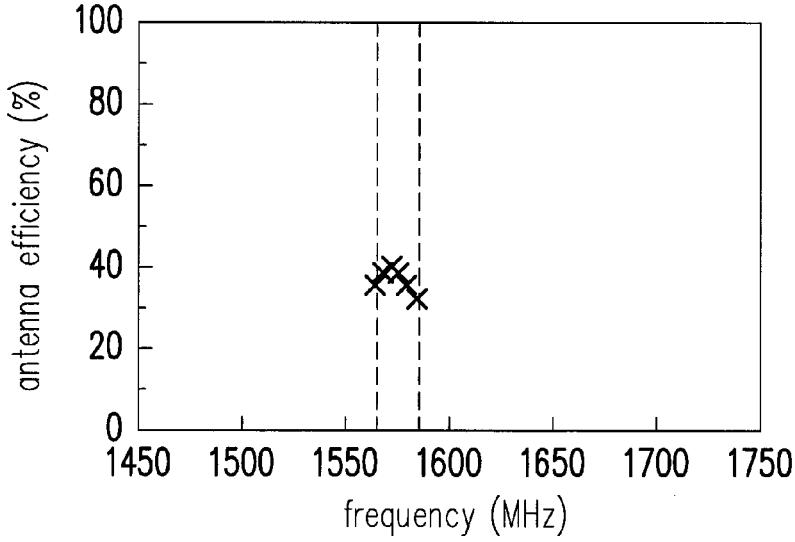

FIGS. 5 and 6 are diagrams for illustrating return loss diagram and antenna efficiency of the antenna element of embodiment of FIG. 4. In the embodiments of FIGS. 5 and 6, an area of the ground plane 110 is approximately 115×60 $mm^2$, and an area of the clearance area is approximately 11×5 $mm^2$. In addition, a length and a width of the radiation element 120 are approximately 15 mm and 1 mm, respectively. Further, the mobile communication device 400 may adjust the resonant frequency of the antenna element through the capacitive element 131 and the radiation element 120. A length of a resonant path of the antenna element is approximately 29 mm, and the length of the resonant path is approximately 0.15 times a wavelength of the resonant frequency.

Accordingly, as shown in FIG. 5, a band range of the antenna element is approximately 1,565 MHz to 1,585 MHz, so that the mobile communication device 400 can be applied in a Global Positioning System (GPS) as a result. Further, because the antenna element is capable of radiating through the resonant mode of the ground plane 110, the radiation characteristic of the antenna element is not prone to affection in miniature design of the mobile communication device 400. In addition, the matching circuit may further improve the radiation characteristic of the antenna element, so as to effectively improve communication performance of the antenna element. For instance, as shown in FIG. 6, an antenna efficiency of the antenna element within 1,565 MHz to 1,585 MHz may reach up to 30% to 40%.

Figure 7:
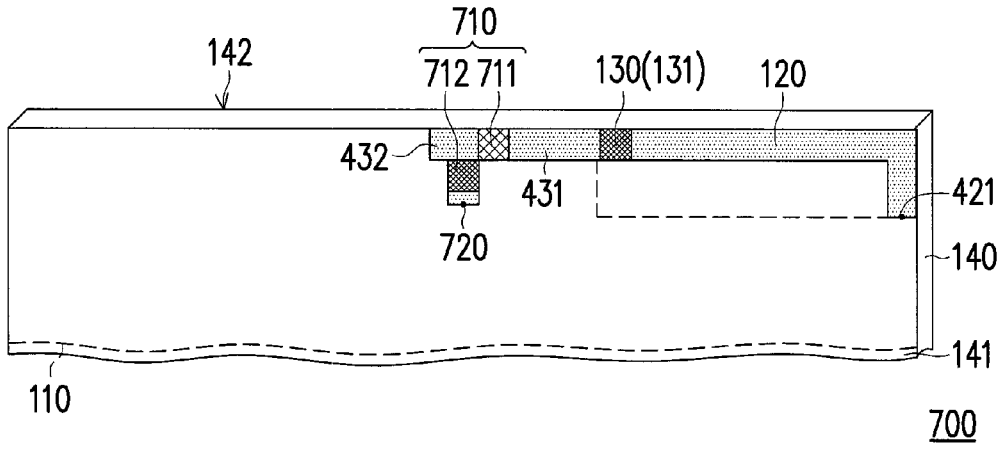
FIG. 7 is a schematic diagram of a mobile communication device according to another embodiment of the invention.

Although an implementation of the matching circuit 410 is illustrated in FIG. 4, the invention is not limited thereto. For instance, FIG. 7 is a schematic diagram of a mobile communication device according to another embodiment of the invention. A mobile communication device 700 depicted in FIG. 7 is an extension of the embodiment of FIG. 4, a major difference between the two is that: a matching circuit 710 includes an inductive element 711 and a capacitive element 712.

More specifically, a first terminal of the inductive element 711 is electrically connected to the resonant circuit 130, and a second terminal of the inductive element 711 receives the feeding signal. The capacitive element 712 is electrically connected between the second terminal of the inductive element 711 and the ground plane 110. Because the matching circuit 710 and the ground plane 110 are disposed on the two opposite surfaces 141 and 142, the capacitive element 712 in the matching circuit 710 is electrically connected to the ground plane 110 through a via hole 720. Detailed description regarding other components of the embodiment of FIG. 7 has been included foregoing embodiments, thus it is omitted hereinafter.

Figure 8:
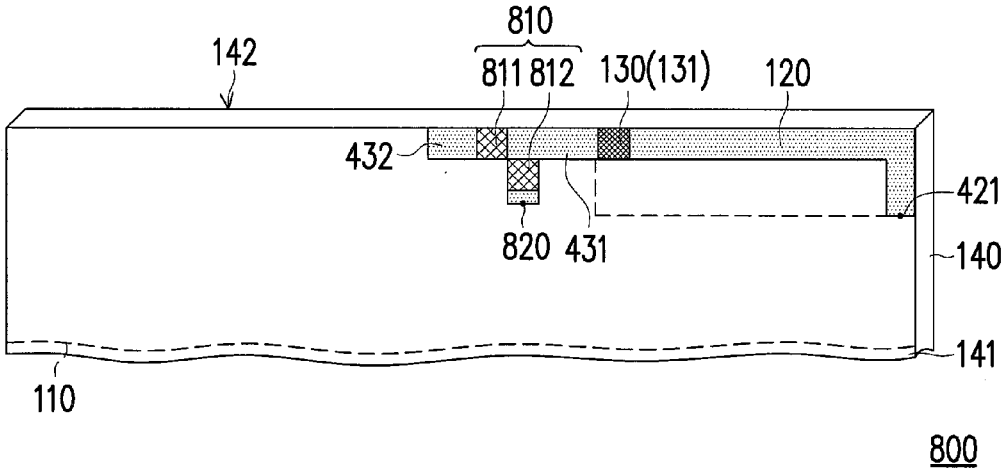
FIG. 8 is a schematic diagram of a mobile communication device according to another embodiment of the invention.

FIG. 8 is a schematic diagram of a mobile communication device according to another embodiment of the invention. A mobile communication device 800 depicted in FIG. 8 is an extension of the embodiment of FIG. 4, a major difference between the two is that: a matching circuit 810 includes an inductive element 811 and an inductive element 812. More specifically, a first terminal of the inductive element 811 is electrically connected to the resonant circuit 130, and a second terminal of the inductive element 811 receives the feeding signal. The inductive element 812 is electrically connected between the first terminal of the inductive element 811 and the ground plane 110. Because the matching circuit 810 and the ground plane 110 are disposed on the two opposite surfaces 141 and 142, the inductive element 812 in the matching circuit 810 is electrically connected to the ground plane 110 through a via hole 820. Detailed description regarding other components of the embodiment of FIG. 8 has been included foregoing embodiments, thus it is omitted hereinafter.

In addition, although the resonant circuit 130 is composed of the capacitive element 131 as illustrated in FIG. 4, FIG. 7 and FIG. 8, the invention is not limited thereto. For instance, the resonant circuit 130 in FIG. 4, FIG. 7 and FIG. 8 may also be implemented by adopting the resonant circuit 210 depicted in FIG. 2, or the resonant circuit 310 depicted in FIG. 3. Further, although the antenna element and the matching circuit 410 are disposed on the same surface 141 of the substrate 140 in FIG. 4, FIG. 7 and FIG. 8, the invention is not limited thereto. For example, the antenna element of FIG. 4, FIG. 7 and FIG. 8 may also be disposed together with the ground plane 110 on the second surface 142 of the substrate 140, and the resonant circuit 310 in the antenna element may be electrically connected to the matching circuit located on the first surface 141 through a via hole.

In summary, the invention forms the antenna element by using the radiation element which is connected to the ground plane and the resonant circuit. In addition, the antenna element can excite the ground plane to generate a resonant mode thereby radiating through the resonant mode of the ground plane. Accordingly, the antenna element can form a ground plane element, so as to facilitate in reducing the size of the antenna element. In addition, the radiation characteristic of the antenna element is not prone to affection in miniature design of the mobile communication device, so as to effectively improve communication performance of the antenna element.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A mobile communication device, comprising:

a ground plane;

a radiation element having a first terminal directly connected to the ground plane, and providing an inductance; and a resonant circuit having a first terminal electrically connected to a second terminal of the radiation element and a second terminal receiving a feeding signal, and providing a capacitance, wherein the resonant circuit and the radiation element are electrically connected in series between the feeding signal and the ground plane to form an antenna element having a loop antenna structure, the antenna element acts as a resonator and resonates at a resonant frequency determined by the inductance and the capacitance, the antenna element excites the ground plane, the ground plane generates a resonant mode in response to the excitation of the antenna element, and the resonant circuit comprises:

a first capacitive element having a first terminal electrically connected to the radiation element, and a second terminal configured to receive the feeding signal; and a first inductive element electrically connected between the first terminal of the first capacitive element and the radiation element.

2. The mobile communication device of claim 1, wherein the antenna element is a ground plane antenna and radiates through the resonant mode generated by the ground plane.

3. The mobile communication device of claim 2, wherein a length of a resonant path of the antenna element is 0.1 to 0.2 times a wavelength of the resonant frequency.

4. The mobile communication device of claim 1, further comprising a matching circuit, and the resonant circuit receives the feeding signal through the matching circuit.

5. The mobile communication device of claim 4, wherein the matching circuit comprises:

a second inductive element having a first terminal electrically connected to the resonant circuit, and a second terminal receiving the feeding signal; and a third inductive element electrically connected between the first terminal of the second inductive element and the ground plane.

6. The mobile communication device of claim 5, wherein the matching circuit further comprises a second capacitive element electrically connected between the second terminal of the second inductive element and the ground plane.

7. The mobile communication device of claim 4, wherein the matching circuit comprises:

a second inductive element having a first terminal electrically connected to the resonant circuit, and a second terminal receiving the feeding signal; and a second capacitive element electrically connected between the second terminal of the second inductive element and the ground plane.

8. The mobile communication device of claim 4, further comprising a substrate, the matching circuit being disposed on a first surface of the substrate, the ground plane being disposed on a second surface of the substrate, and the radiation element and the resonant circuit being disposed on the first surface or the second surface.

* * * * *